US005857597A

United States Patent [19]

Kolton

[11] Patent Number: 5,857,597

[45] **Date of Patent: *Jan. 12, 1999**

[54] ARTICLE HANGER

[75] Inventor: Chester Kolton, Westfield, N.J.

[73] Assignee: B & G Plastics, Inc., Newark, N.J.

[ * ] Notice: The term of this patent shall not extend beyond the expiration date of Pat. No. 5,772,087.

[21] Appl. No.: 826,301

[22] Filed: Mar. 27, 1997

[51] Int. Cl.[6] ..... A47G 25/41; A45C 13/06

[52] U.S. Cl. ..... 223/85; 223/1; 223/87; 150/131

[58] Field of Search ..... 223/DIG. 1, 94, 223/89, 85, 87, 88; 150/131

[56] References Cited

U.S. PATENT DOCUMENTS

| | | | |
|---|---|---|---|
| 3,065,946 | 11/1962 | Bekow | 248/317 |
| 3,241,733 | 3/1966 | Tillery | 223/87 |
| 3,246,812 | 4/1966 | Walker | 223/87 |
| 3,790,045 | 2/1974 | Rigel et al. | 223/87 |
| 3,945,500 | 3/1976 | Meckstroth | 211/113 |
| 4,932,571 | 6/1990 | Blanchard | 223/94 |
| 5,123,577 | 6/1992 | Kolton et al. | 223/85 |
| 5,328,065 | 7/1994 | Kolton et al. | 223/85 |
| 5,429,284 | 7/1995 | Kolton et al. | 223/85 |
| 5,501,378 | 3/1996 | Kolton et al. | 223/87 |
| 5,620,118 | 4/1997 | Kolton et al. | 223/85 |

*Primary Examiner*—Bibhu Mohanty
*Attorney, Agent, or Firm*—Robin, Blecker & Daley

[57] ABSTRACT

A hanger is comprised of a one-piece body having a hook portion for the receipt of a display rod, a central portion depending from the hook portion, the body defining in the central portion a transverse opening therethrough fully bounded by the central portion, a fold line portion depending from the central portion and a flap segment depending from the fold line segment, the central portion, the fold line portion and the flap segment jointly defining a slot in the body which opens into a margin of the body, the central portion defining a notch bounding the slot and transversely coextensive with the transverse opening. An article displayed by the hanger has a fold part disposed in the transverse opening and at least first and second parts extending from the fold part. The first part is disposed between hanger flap segment and the hanger central portion and the second part is disposed fully exteriorly of the hanger.

15 Claims, 4 Drawing Sheets

ARTICLE HANGER

FIELD OF THE INVENTION

This invention relates generally to hangers for articles and pertains more particularly to hangers for the display of wallets.

BACKGROUND OF THE INVENTION

By way of introduction to the subject invention, reference is made to commonly-assigned U.S. Pat. No. 5,429,284. This patent discloses a garment hanger comprised of a one-piece body having a hook portion for the receipt of a display rod, a central portion depending from the hook portion and having first and second openings therein, and a fold line portion depending from the central portion with a third opening disposed in the fold line portion and a flap segment depending from the fold line portion. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the garment and latched to the central portion.

By way of further introduction to the subject invention, reference is made to commonly-assigned U.S. Pat. No. 5,501,378. This patent discloses a garment hanger comprised of a one-piece body having a hook portion for the receipt of a display rod, a central portion depending from the hook portion, the body defining in the central portion an opening therethrough and a garment support member disposed in the opening and movable relative to the body and a lower portion defining a fold line portion depending from the central portion and a flap segment depending from the fold line segment, the central portion, the fold line segment and the flap segment jointly defining a slot in the body which opens into a margin of the body.

The central portion and the flap segment define coactive means for retaining the flap segment against the central portion on folding of the flap segment about the fold line segment.

The fold line portion is disposed contiguously with an interior end of the slot and provides cantilever support for the flap segment.

Assembly of the hanger with a garment is greatly facilitated by the configuration of the support member as a single member supported for movement outwardly of the plane of the hanger body for ready receipt of a loop of the garment and by the slot configuration, i.e., an extent of the garment depending from the loop is insertable sideways into the slot.

SUMMARY OF THE INVENTION

The present invention has as its primary object the provision of hangers for the hanging of articles having parts of diverse thickness, such as wallets, which have a fold part interiorly of credit card pocket parts and of less thickness than the credit card pocket parts.

In attaining this and other objects, the invention provides a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment depending from the fold line segment, the central portion, the fold line portion and the flap segment jointly defining a slot in the body which opens into a margin of the body, the central portion defining a notch bounding the slot and transversely coextensive with the transverse opening.

The invention provides further, in combination, a hanger comprised of a one-piece body having a hook portion for the receipt of a display rod, a central portion depending from the hook portion, the body defining in the central portion a transverse opening therethrough fully bounded by the central portion, a fold line portion depending from the central portion and a flap segment contiguous with the fold line portion and secured to the central portion and an article having a first part disposed in the transverse opening and at least second and third parts extending outwardly of the one-piece body, a portion of the article second part being disposed between the central portion and the flap segment, the article third part being disposed fully outwardly of the hanger.

The foregoing and other objects and features of the invention will be further evident from the following detailed description of a preferred embodiment thereof and from the drawings in which like components are identified by like reference numerals throughout.

DETAILED DESCRIPTION OF THE PREFERRED EMBODIMENTS

Figure 2:
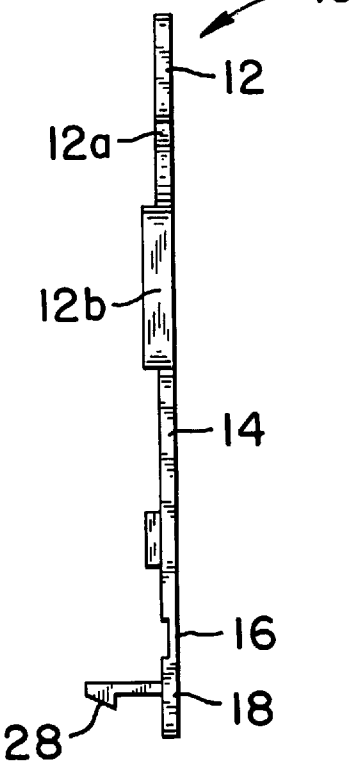
FIG. 2 is a right side elevational view of the FIG. 1 hanger.
Figure 1:
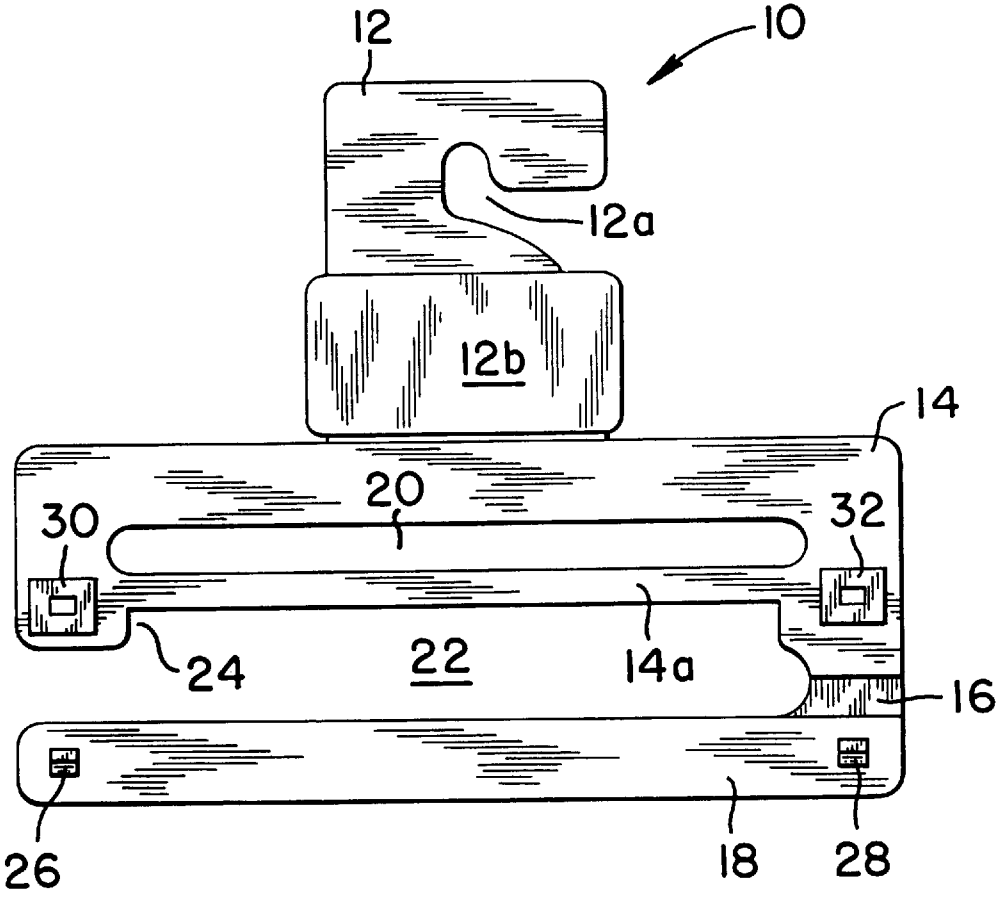
FIG. 1 is a rear elevational view of a hanger in accordance with the invention prior to its assembly with an article to be hung for display.

Referring to FIGS. 1 and 2, hanger 10 in accordance with the invention is comprised of a one-piece body having a hook portion 12 with a channel 12*a* for the receipt of a display rod and with a logo display area 12*b*, a central portion 14 depending from the hook portion, a fold portion 16 depending from the central portion and a flap segment 18 depending from fold portion 16 and cantilever-supported thereby. Fold portion 16 is constituted by thinning out the one-piece body to have a lesser thickness than the thickness of central portion 14 and flap segment 18, as is shown in FIG. 2.

The body defines in central portion 14 a transverse opening 20 therethrough, fully bounded by central portion 14. Central portion 14, fold line portion 16 and flap segment 18 collectively define slot 22 in the body which opens into a margin of the body. Central portion 14 has a notch 24 formed therein as a part of slot 22 and the notch extends transversely coextensive with transverse opening 20 beneath crossbar 14*a* of the central portion.

Central portion 14 and flap segment 18 define coactive means for securing the flap segment against the central portion. The coactive means is preferably comprised of first and second projections 26 and 28 on flap segment 18 adjacent respective lateral margins thereof and first and second latching openings 30 and 32 in the central portion adjacent respective lateral margins thereof.

While the hanger may be constructed such that the coactive means is releasable, it is preferred that the retention not be releasable and that cutting is required to remove an article from the hanger.

Figure 3:
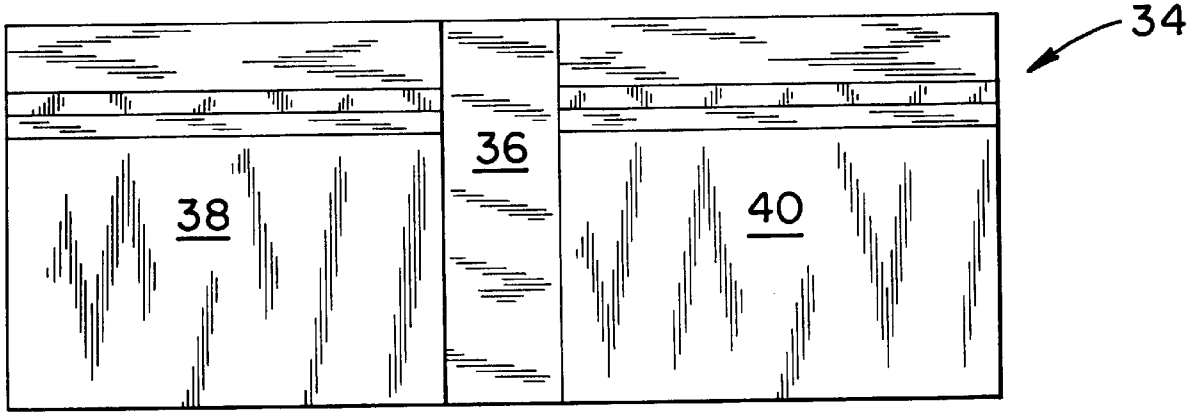
FIG. 3 is a front elevation of a conventional wallet having a fold part and two credit card pocket parts.
Figure 4:
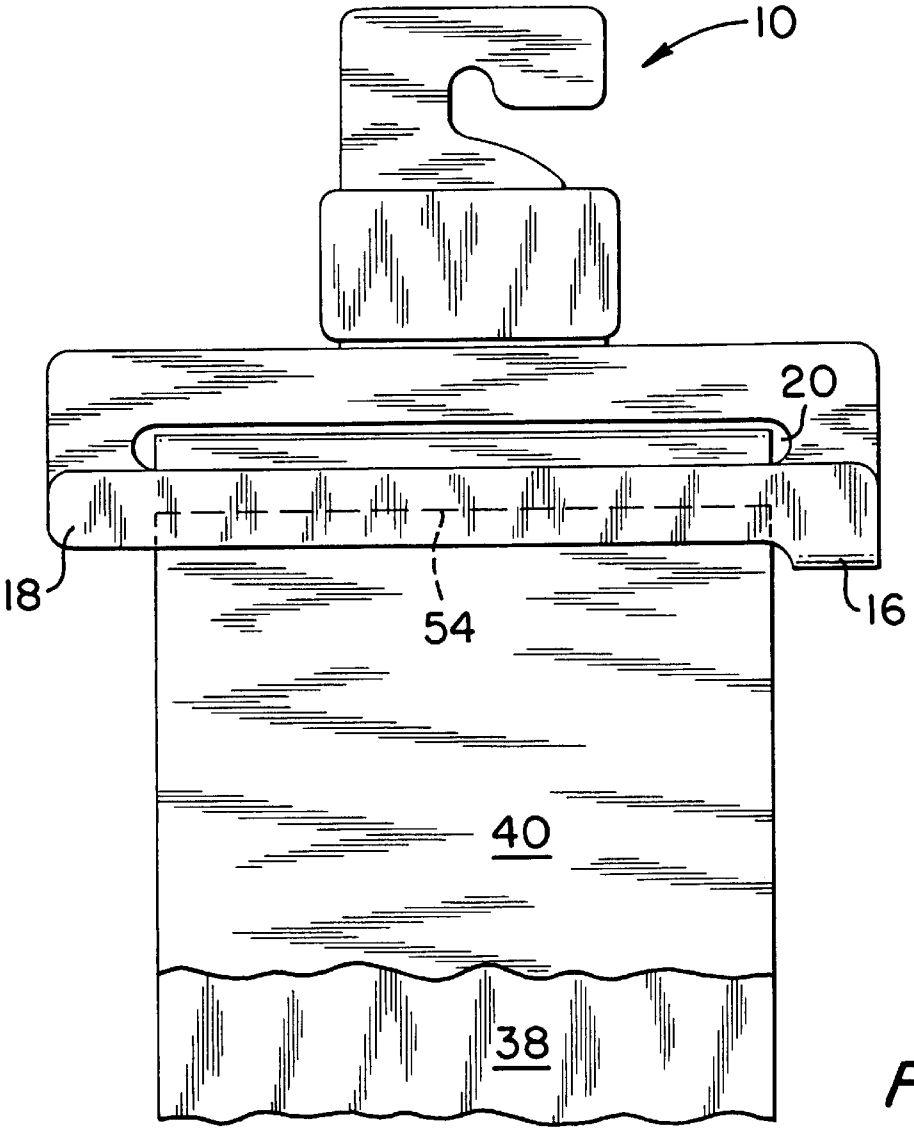
FIG. 4 is a rear elevational view of the FIG. 1 hanger assembled with wallet of FIG. 3.

Referring to FIG. 3, known wallet 34 has a fold part 36 and credit card pocket parts 38 and 40 forwardly of a bill compartment (not shown). In FIG. 4, hanger 10 is shown in assembly with wallet 34 with the wallet partly broken away. In reaching the assembly of FIG. 3, wallet part 38 is inserted, free end first, into opening 20 of hanger 10 until fold part 36 is resident in opening 20. At this juncture, wallet part 40 is placed in slot 18, the placement being facilitated by the cantilever-support of flap segment 18 by fold portion 16. Wallet part 38 is disposed fully exteriorly of hanger 10. Flap segment 18 is now folded about fold portion 16, i.e., onto wallet part 40, wallet fold part 36 being ensnared between flap segment 18 and crossbar 14*a* of hanger central portion 14 upon engagement of projections 26 and 28 and latching openings 30 and 32.

As will be appreciated, upon rotation of the FIG. 3 assembly by one-hundred and eighty degrees, hook portion 12 is insertable onto a display rod from the right hand side of the rod and wallet part 38 is fully viewable to a shopper and may be lifted for shopper inspection of the wallet without need for disassembly of the wallet and hanger. Upon lifting of wallet part 38, wallet part 40 is likewise fully viewable. In this connection, broken line 54 of FIG. 4 indicates the uppermost borders of wallet parts 38 and 40 and the bottom of crossbar 14a is upwardly of broken line 54.

Figure 5:
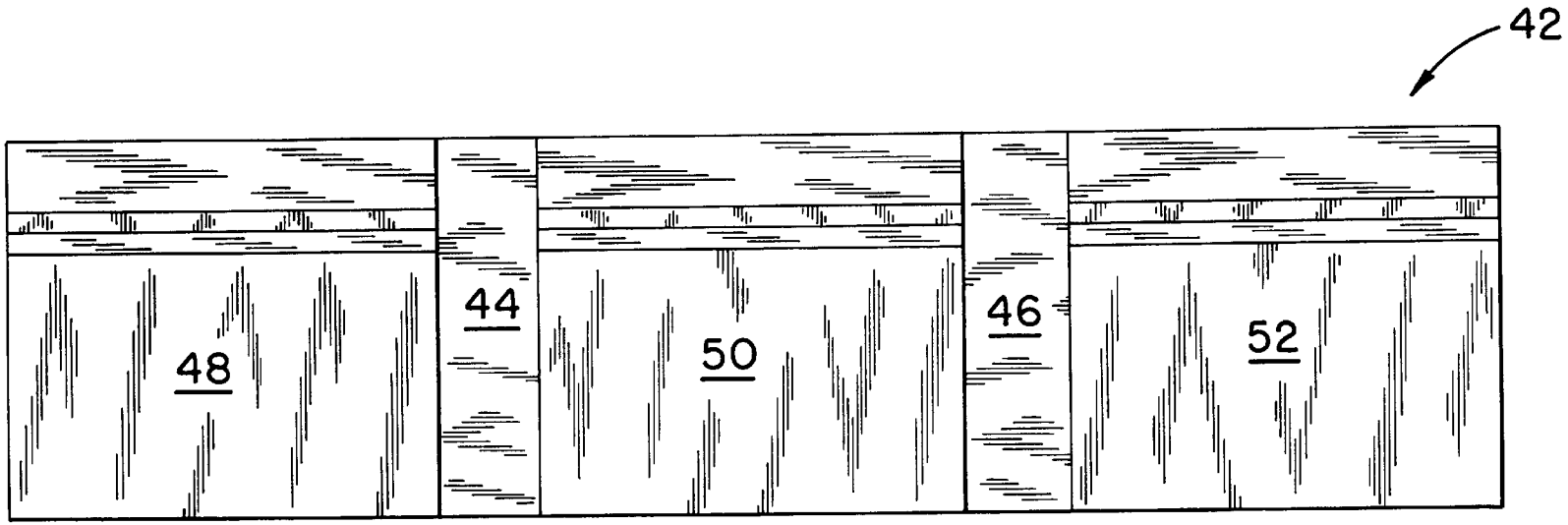
FIG. 5 is a front elevation of a conventional wallet having two fold parts and three credit card pocket parts.
Figure 6:
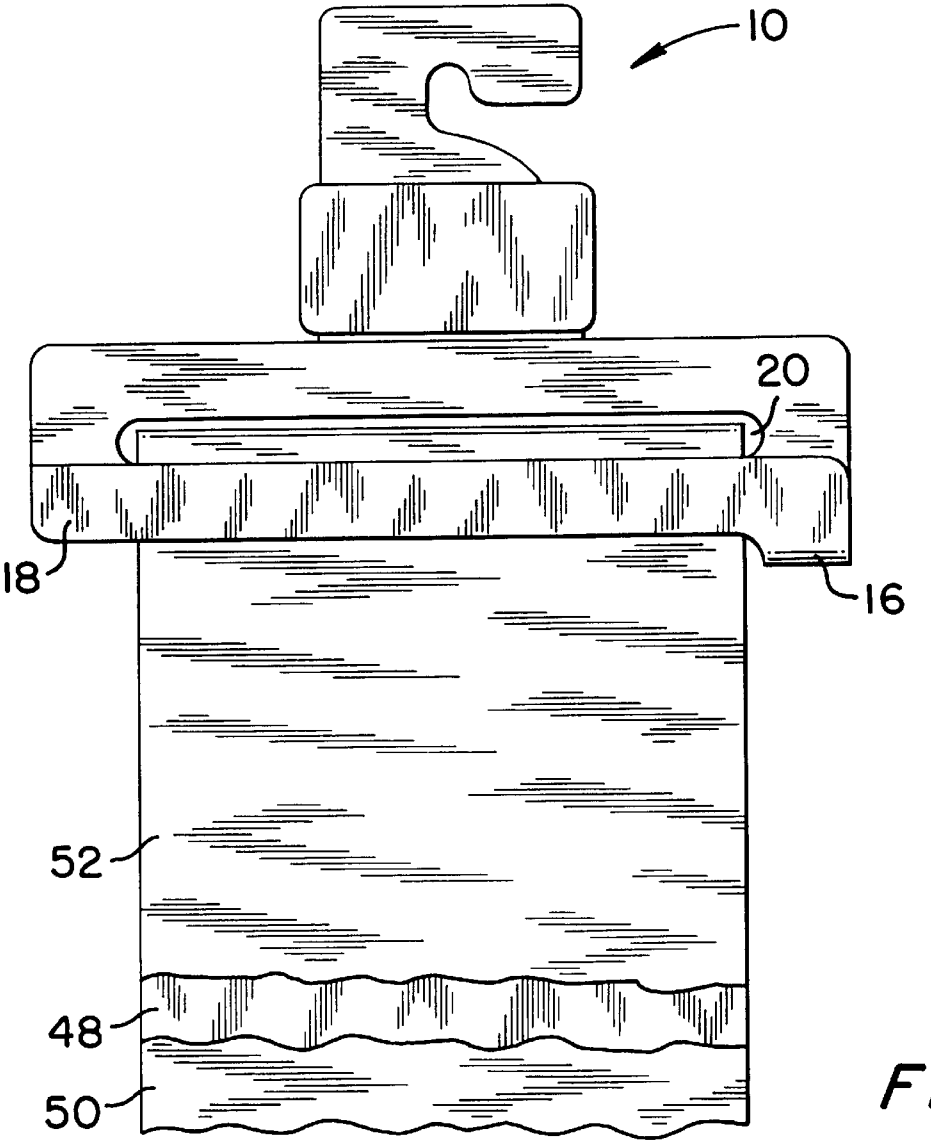
FIG. 6 is a rear elevational view of the FIG. 1 hanger assembled with wallet of FIG. 5.

Referring to FIG. 5, known wallet 42 has fold parts 44 and 46 and pocket parts 48, 50 and 52. In FIG. 6, hanger 10 is shown in assembly with wallet 42 with the wallet partly broken away. In reaching the assembly of FIG. 6, wallet part 48 is inserted into opening 20, followed by wallet part 50 insertion through the opening until fold part 46 is resident in opening 20. Wallet part 52 is now ensnared between crossbar 14*a* and flap segment 18. Wallet part 48 is now folded about fold part 44 and is frictionally nested between wallet parts 50 and 52.

Wallet part 50 is disposed fully exteriorly of hanger 10 in its closed state and is fully viewable to a shopper and may be lifted for shopper inspection of wallet part 48 by withdrawing it from its nest. At this stage, all three wallet pocket parts are viewable by the shopper, without need for disassembly of the wallet and hanger.

Various changes to the particularly disclosed embodiment and practices may evidently be introduced without departing from the invention. By way of example, the illustrated latching structure is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A hanger comprised of a one-piece body having a hook portion for the receipt of a display rod, a central portion depending from said hook portion, said body defining in said central portion a transverse opening therethrough fully bounded by said central portion, a fold line portion depending from said central portion and a flap segment depending from said fold line segment, said central portion, said fold line portion and said flap segment jointly defining a slot in said body which opens into a margin of said body, said central portion defining a notch bounding said slot and transversely coextensive with said transverse opening, said slot being at least transversely coextensive with each of said transverse opening and said notch.

2. The hanger claimed in claim 1, wherein said central portion and said flap segment define coactive means for retaining said flap segment against said central portion on folding of said flap segment about said fold line portion.

3. The hanger claimed in claim 1, wherein said fold line portion is contiguous with an interior end of said slot and provides cantilever support for said flap segment.

4. The garment hanger claimed in claim 2, wherein said coactive means is comprised of at least one projection on said flap segment and at least one latching opening in said central portion.

5. The garment hanger claimed in claim 2, wherein said coactive means is comprised of first and second projections on said flap segment adjacent respective lateral margins thereof and first and second latching openings in said central portion adjacent respective lateral margins thereof.

6. In combination:

(a) a hanger comprised of a one-piece body having a hook portion for the receipt of a display rod, a central portion depending from said hook portion, said body defining in said central portion a transverse opening therethrough fully bounded by said central portion, a fold line portion depending from said central portion and a flap segment contiguous with said fold line portion and secured to said central portion; and (b) an article having a first part disposed in said transverse opening and at least second and third parts extending outwardly of said one-piece body, a portion of said article second part being disposed between said central portion and said flap segment, said article third part being disposed fully outwardly of said hanger.

7. The invention claimed in claim 6, wherein said article first part is of lesser thickness than said article second and third parts.

8. The invention claimed in claim 6, wherein said article includes a fourth part nested interiorly of said second and third parts.

9. The invention claimed in claim 6, wherein said central portion defines a notch extending transversely coextensively with said transverse opening.

10. The invention claimed in claim 6, wherein said central portion and said flap segment define coactive means for securing said flap segment against said central portion.

11. The invention claimed in claim 10, wherein said fold line portion provides cantilever support for said flap segment.

12. The garment invention claimed in claim 10, wherein said coactive means is comprised of at least one projection on said flap segment and at least one latching opening in said central portion.

13. The garment invention claimed in claim 10, wherein said coactive means is comprised of first and second projections on said flap segment adjacent respective lateral margins thereof and first and second latching openings in said central portion adjacent respective lateral margins thereof.

14. The invention claimed in claim 6, wherein said article is a wallet.

15. The invention claimed in claim 8, wherein said article is a wallet.

* * * * *